US006454474B1

(12) United States Patent
Lesniak et al.

(10) Patent No.: US 6,454,474 B1
(45) Date of Patent: Sep. 24, 2002

(54) CALIBRATION OF A MEDIA ADVANCE SYSTEM

(75) Inventors: Christopher M. Lesniak, Vancouver, WA (US); Algird M. Gudaitis, Vancouver, WA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 10/003,163

(22) Filed: Nov. 14, 2001

Related U.S. Application Data

(63) Continuation of application No. 09/564,383, filed on Apr. 27, 2000, now Pat. No. 6,364,549.

(51) Int. Cl.[7] ..... B41J 11/42
(52) U.S. Cl. ..... 400/582; 101/484
(58) Field of Search ..... 400/582, 578, 400/74; 101/484

(56) References Cited

U.S. PATENT DOCUMENTS 4,533,269 A * 8/1985 Pou et al. ..... 101/127
4,734,868 A 3/1988 DeLacy
4,844,317 A 7/1989 Stodder
4,916,638 A 4/1990 Haselby
5,351,068 A 9/1994 Moon
5,488,396 A 1/1996 Burke
5,529,414 A 6/1996 Katano
5,598,201 A 1/1997 Stodder
5,600,350 A 2/1997 Cobbs
5,825,378 A * 10/1998 Beauchamp ..... 347/19
6,016,207 A 1/2000 Wield
6,017,114 A 1/2000 Elgee
6,017,160 A 1/2000 Sato
6,128,097 A 10/2000 Parker
6,137,592 A * 10/2000 Arquilevich et al. ..... 358/1.8
6,158,344 A * 12/2000 Walker et al. ..... 101/483

* cited by examiner

*Primary Examiner*—Andrew H. Hirshfeld
*Assistant Examiner*—Charles H. Nolan, Jr.

(57) ABSTRACT

A simple, yet accurate way of determining calibration values for correcting the characteristic sinusoidal feed errors of a printer or other recording device (such as a fax machine, plotter, etc.). A sheet of calibration media is employed for facilitating the calculation of the calibration values. The sheet is used in a way that prevents the calibration media errors from affecting the calculation. In particular, the sheet of calibration media is fed twice through the printer, and position data is collected each time. The data is processed in a way that cancels the attendant calibration media errors so that the calculated calibration values precisely correct the characteristic sinusoidal feed errors of that printer.

6 Claims, 1 Drawing Sheet

CALIBRATION OF A MEDIA ADVANCE SYSTEM

CROSS REFERENCE TO RELATED APPLICATION(S)

This is a continuation of application Ser. No. 09/564,383 filed on Apr. 27, 2000, now U.S. Pat. No. 6,364,549 which is hereby incorporated by reference herein.

TECHNICAL FIELD

This invention relates to methods and apparatus for accurate advancement of media in a printer or other recording device.

BACKGROUND AND SUMMARY OF THE INVENTION

One type of ink-jet printer includes at least one print cartridge that contains ink within a reservoir. The reservoir is connected to a printhead that is mounted to the body of the cartridge. The printhead is controlled for ejecting minute drops of ink from the printhead to a sheet of print medium, such as paper, that is advanced through the printer.

The printer includes a carriage for holding the print cartridge. The carriage is scanned across the width of the paper, and the ejection of the drops onto the paper is controlled to form a swath of an image with each scan. The height of the printed swath (as measured in the direction the media is advanced) is fixed for a particular printhead.

Between carriage scans, the media is advanced so that the next swath of the image may be printed. In most cases, the base of the just-printed swath must be precisely aligned with the top of the next-printed swath so that a continuous image may be printed on the paper. Alternatively, the paper may be advanced by less that a full swath height to effect "shingling" type of printing. In any event, inaccurate media advances between scans of the carriage result in print quality artifacts known as banding.

The prevention of banding artifacts thus calls for precise control of the advancing media in discrete steps between printed swaths. The demand for accuracy in advancing media becomes greater as printhead development leads to higher and higher resolutions, thereby reducing the tolerances permitted in advancing the media.

Rotary optical encoders with associated servo systems are commonly used in printers for accurately advancing print media between carriage scans. The encoder is connected to a media advance mechanism of the printer (drive motor, drive roller, etc.) and its output signals provide the microprocessor based printer controller with an indication of the position of the media as the media is advanced through the printer. The controller, in turn, controls the drive motor as needed to incrementally advance the media.

The encoder is not located in direct contact with the print media. Rather, the encoder is connected to the drive roller or other mechanism as mentioned above. As a result, the encoder position only indirectly reflects the actual position of the media. Moreover, a rotary encoder, as well as the media drive roller, is susceptible to runout errors. As is known in the art, runout errors are sinusoidally varying errors that occur as a result of slight variations in the concentricity of a mechanism. For instance, a runout error attributable to a drive roller arises when the outer surface of a drive roller is not precisely concentric with the axis about which that roller rotates.

As a consequence of runout errors, the magnitude of the media position changes as represented by the encoder output signals will not precisely match the actual position change of the media. The errors attributable to encoder and drive roller runout will combine into a single characteristic sinusoidal feed error for that particular printer. It is this overall error that must be accounted for in order to accurately advance the media in the printer.

The recognition of runout errors and the general notion of accounting for such errors have produced a few solutions. For example, one can employ a second rotary encoder that is mounted 180° out of phase with the primary encoder. The combined output of both encoders has the effect of averaging out the runout errors of the encoders. This approach, however, does not account for runout errors of the drive roller or other associated rotating media advance components that are between the encoders and the print media. The provision of a second encoder also adds significant cost to the system.

Another approach to addressing runout errors (as described in U.S. Pat. No. 5,825,378) is to draw a series of lines on media using a swath-type printer. The lines correspond to an angle of rotation of the drive roller or platen that carries the media. A carriage-mounted optical sensor thereafter reads the actual position of the lines, and this position information is used to generate a correction signal. This approach, however, is limited by the accuracy of the encoder system that is used with the carriage drive, as well as unrelated dot-placement errors associated with ink-jet printers.

The present invention is directed to a simple, yet accurate way of determining calibration values for correcting the characteristic sinusoidal feed errors of a printer or other recording device (such as a fax machine, plotter, etc.).

In the preferred embodiment of the invention, a sheet of calibration media is employed for facilitating the calculation of the calibration values. The sheet carries a number of targets and is used in a way that prevents the calibration media errors from affecting the calculation. The term "calibration media errors" generally means the errors or deviations between the measured, nominal locations of the targets and the actual locations of the targets on the sheet resulting from inaccuracies in measurement of those targets, which would otherwise introduce additional errors, and thus defeat the calibration process.

As will be described below, the calibration media is fed twice through the printer, and target-position data is collected each time. According to the present invention, the position data is processed in a way that cancels the attendant calibration media errors so that the calculated calibration values precisely correct the characteristic sinusoidal feed error of that printer.

Inasmuch as the errors associated with the calibration media are cancelled, the approach of the present invention dramatically reduces the precision (hence, cost) with which the calibration media need be prepared. This, in turn, makes it possible to generate the sheet of calibration media, at any time desired. One can even use the printer being calibrated for generating the calibration sheet.

Other advantages and features of the present invention will become clear upon review of the following portions of this specification and the drawings.

DETAILED DESCRIPTION OF PREFERRED EMBODIMENTS

Figure 1:
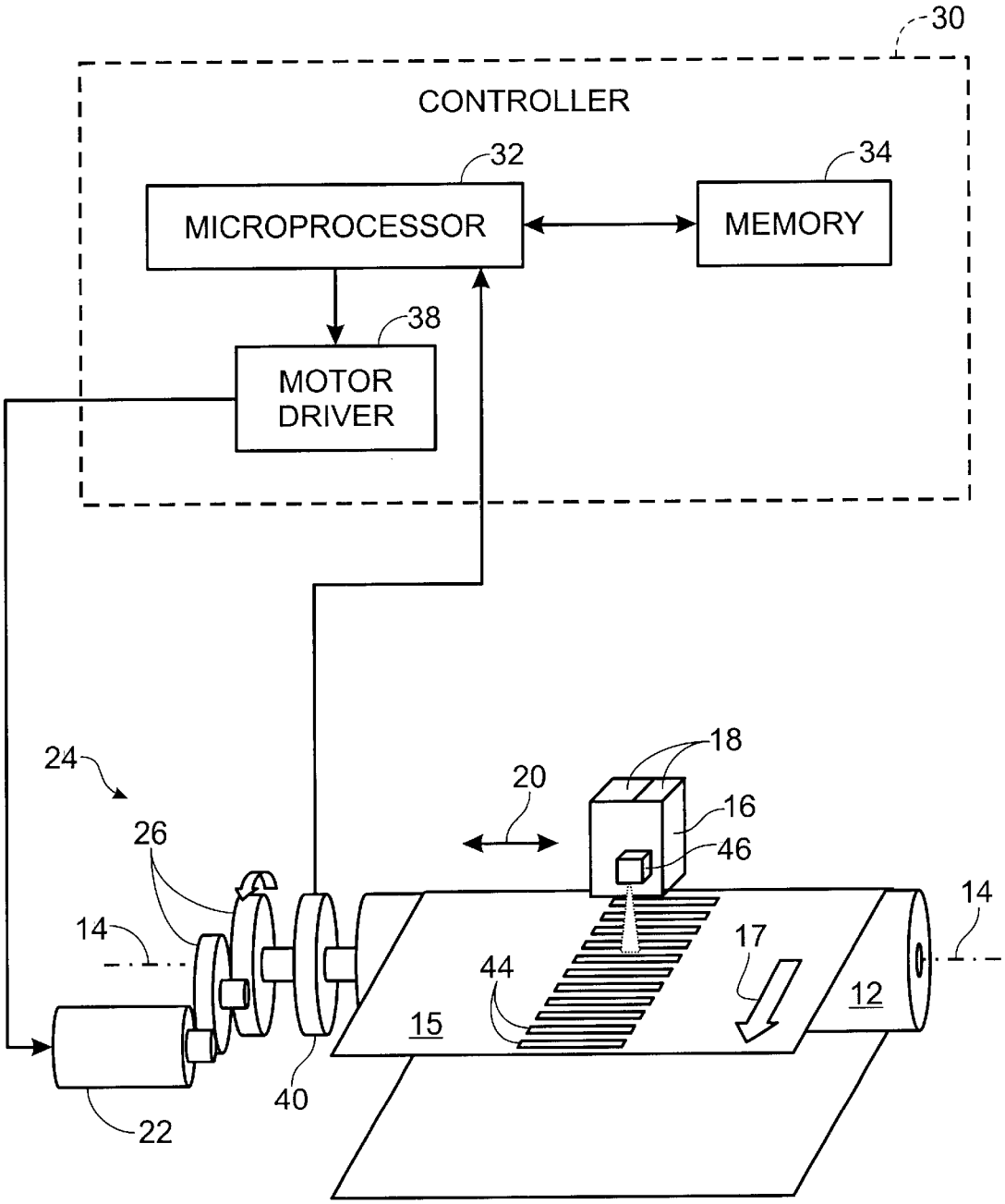
FIG. 1 is combined schematic and block diagram of a recording device (here, an ink-jet printer) with which the present invention may be adapted.

FIG. 1 depicts media-advance and print controller components of an ink-jet printer for which the present invention may be adapted. The system includes a drive roller 12 that rotates about a paper axis 14 to advance, incrementally, paper 15 in a paper-advance direction shown by arrow 17. Other printable media (transparencies, photo media, etc.) may be used as well as paper. As will be described more below, the particular sheet of media illustrated in FIG. 1 is a calibration sheet 15 that is used with the calibration process of the present invention.

The printer includes a carriage 16 that supports one or more conventional print cartridges 18 (two shown in FIG. 1: a multicolor ink cartridge and a black ink cartridge). During a printing operation, the carriage 16 is supported to scan back and forth across the paper 15 in a direction 20 perpendicular to the paper-advance direction 17.

As the carriage 16 is scanned across the paper, a swath of an image or text may be printed to the underlying paper. That is, the print cartridges 18 are controlled to print a swath of information. After that swath is printed, the media-advance mechanisms 24 are operated to advance the paper by one swath height (measured parallel to the paper-advance direction 17) so that the next swath may be printed by the cartridges 18 as the carriage is scanned back across the paper.

The paper advance mechanisms include, in addition to the drive roller 12, a motor such as a DC drive motor 22 that is connected via gears 26 to the drive roller 12. The motor 22 controls the paper advance movement. It is pointed out that any of a variety of mechanisms may be employed for linking the motor 22 and drive roller 12 for controlled advance of the paper.

As noted above, the paper advance mechanisms must be controlled in a manner that advances the paper in precise increments from a first position to a second position between scans by the carriage 16. FIG. 1 includes a block diagram of a printer controller 30 that controls this motion.

In particular, the printer controller 30 includes a multipurpose microprocessor 32, which, for the purposes of simplicity, is described here in connection only with its paper advance and calibration tasks. That processor includes associated memory 34, at least a portion of which is preprogrammed to carry out the method of the present invention as explained below.

Whenever a print task is undertaken and, in particular, whenever the print media needs to be advanced by one discrete increment, the microprocessor 32 provides via motor driver 38 signals that are suitable for driving the motor 22. In this regard, the signals may be in the form of a drive voltage placed across the input terminals of the motor. The resulting current rotates the motor shaft and connected gears 26 and drive roller 12.

The microprocessor is apprised by the printer firmware (memory 34) of the distance that the paper must be advanced after each swath is printed. The motor motion (which is correlated. to the paper advance distance) is monitored by microprocessor 32 via a conventional rotary encoder 40 that, in this embodiment, is associated with the rotating shaft of the drive roller 12. It will be appreciated that the encoder 40 may be connected to the media advance components at any of a variety of locations. For instance, the encoder may be directly connected to the shaft of the drive motor 22.

Suitably conditioned encoder output signals are provided by the encoder 40 to the microprocessor 32. These signals provide information as to the instantaneous encoder position so that the microprocessor can discern the corresponding paper position in the course of controlling movement of that paper via the drive motor 22.

As noted above, a rotary encoder 40 and a media drive roller 12 are susceptible to runout errors. These runout errors combine to define a characteristic sinusoidal feed error for the printer. Thus, a calibration process is undertaken for developing calibration values that are thereafter used to correct the encoder position information to account for this feed error and thus accurately advance the media during a printing operation.

In accordance with the present invention, the calibration process employs the use of a sheet of calibration media 15 that carries spaced-apart calibration lines or targets 44. In a preferred embodiment, the calibration targets 44 may be printed onto the media with sufficient density to enable detection of individual targets via a conventional optical sensor 46.

The sensor 46 is depicted in FIG. 1 as mounted to the carriage 16 of the printer. It is contemplated that any of a variety of sensor arrangements may be employed. For instance, the printer could even be connected to an external sensor for the calibration procedure.

As will become clear, the approach of this embodiment of the present invention removes the problem of ensuring that the calibration sheet is precisely manufactured and handled. In this embodiment, therefore, the calibration sheet 15 may be a sheet of paper that has targets 44 printed thereon by the same printer for which the calibration process is carried out.

As an initial step in the calibration process of the present invention, the sheet of calibration media 15 is fed into the paper path of the printer, into contact with the drove roller 12 that advances the sheet. As shown in FIG. 1, the calibration targets 44 are preferably arranged on the sheet 15 in a linear series of several targets. The series of targets extends in a direction generally parallel to the direction 17 that the sheet is advanced in the printer. It is preferred that the overall length of this series of targets spans a distance corresponding to at least one full cyclical error of a paper advance mechanism. For instance, this distance should correspond to at least one drive roller rotation so that the sinusoidally varying error will be maximized and thus completely reflected in the collected data as described below.

It is contemplated that fewer targets extending over a shorter distance will suffice. For example, as few as three targets may be employed on the calibration sheet and distributed over a distance corresponding to one-half, or less, of the drive roller (or motor shaft) rotation. The accuracy of the calibration values generated with such limited target position data, however, will be correspondingly reduced.

The printer controller 30 monitors the locations of the calibration targets 44 as the sheet is advanced. In this regard, each time the sensor 46 detects an edge of a calibration target 44, the controller logs in memory 34 the corresponding position of the encoder 40 as discerned from the encoder position output signal. The controller also logs the absolute position of the rotary encoder based upon an index mark on the encoder that serves as a zero location. The absolute position measure correlates to the rotation of the encoder and is used in accurately applying or mapping the later-determined calibration values that correct for the characteristic sinusoidal feed error.

Thus, when the calibration sheet 15 is completely advanced through the printer, the controller memory stores a set of position data, preferably in the form of a table of encoder positions at which each calibration target 44 was detected. The same sheet of calibration media 15 is, for a second time, fed into contact with the drove roller 12 that advances the sheet through the printer. The sheet is fed so that it has the same orientation relative to the printer as it did when it was first fed through the printer.

As before, each time the sensor 46 detects an edge of a calibration target 44, the controller logs in memory 34 the corresponding position of the encoder 40 as discerned from the encoder position output signal. The controller also logs the corresponding absolute position of the rotary encoder. This second set of position data is also affected by any errors in the printer's media advance system.

The calibration process requires that the initial or starting position of the drive roller 12 is different each time the sheet is fed through the printer. In this regard, the printer controller will, if necessary, continue to rotate the drive roller 12 for a sufficient amount to ensure this difference before accepting the feed of the calibration sheet for the second time.

Using the sensed position data (which can be characterized as apparent media position), one can write an expression relating the sensed or apparent position data to expected or nominal position data and to the varying encoder position. Such an expression also accounts for calibration media errors. In terms of the first set of position data, that expression is in the form:

$$P_{ap1}(s)=[P_{nom}(s)+P_{err}(s)]+[A\sin(\theta_1)+B\cos(\theta_1)] \quad (1)$$

Where $P_{ap1}(s)$ is the apparent or measured position of each sampled target "s" on the media (as seen by the encoder) associated with the set of position data for the first feed of the calibration sheet. The term $P_{nom}(s)$ is the expected target position, which, in this embodiment, is unknown because the precise spacing between the calibration targets is not measured or stored in advance. The true or actual position of each sampled target "s" is the combination of that expected target position and a measurement or media calibration error $P_{err}(s)$. The angle $\theta_1$ is the corresponding encoder angular position with respect to the index mark. As noted, a table of values of $P_{ap1}(s)$ and $\theta_1$ had been collected and stored as the calibration sheet was fed through the printer the first time. The coefficients A and B are derived via least-squares curve fitting, and thus used to compute the calibration values as described below.

The calibration sheet is fed through the printer a second time, with a different starting position of the drive roller and encoder position angle θ. The second set of data is obtained and represented as:

$$P_{ap2}(s)=[P_{nom}(s)+P_{err}(s)]+[A\sin(\theta_2)+B\cos(\theta_2)] \quad (2)$$

The two data sets can be combined (Equation 2 subtracted from Equation 1) to eliminate the unknown terms, including the calibration media error, $P_{err}(s)$, as follows:

$$P_{ap1}(s)-P_{ap2}(s)=[P_{nom}-P_{nom}]+[P_{err}(s)-P_{err}(s)]+A[\sin(\theta_1)-\sin(\theta_2)]+B[\cos(\theta_1)-\cos(\theta_2)] \quad (3)$$

Since the same calibration sheet is used to generate the two sets of data, the terms $P_{nom}$ and $P_{err}(s)$ cancel because they are constant with respect to the calibration sheet (that is, they are independent of θ).

Equation (3) can be further simplified by letting $\theta_1=\theta$ and $\theta_2=\theta+\Delta$ and letting $E'_{ap}=P_{ap1}(s)-P_{ap2}(s)$. The symbol Δ represents the angular (phase) difference in the absolute encoder positions between the two calibration-sheet feeds. Utilizing trigonometric identities, equation (3) thus becomes:

$$E'_{ap}=A'\sin(\theta)+B'\cos(\theta) \quad (4)$$

where:

$$A'=A-A\cos(\Delta)+B\sin(\Delta) \quad (5)$$

and $$B'=B-B\cos(\Delta)-A\sin(\Delta) \quad (6)$$

The microprocessor 32 then performs a least-squares curve fit on equation (4) to find the best-fit versions of A' and B'. Those coefficients are then used to compute (using equations 5 and 6) the coefficients A and B as in equations (1) and (2). Thus, those coefficients A and B are used in determining the calibration values, or the actual target positions corresponding to the apparent target position information provided by the encoder during a printing operation.

As a further refinement, the process carried out in accord with the present invention computes the least-squares curve-fit on modified version of Equation (4) as shown here:

$$E'_{ap}=A'\sin(\theta)+B'\cos(\theta)+C'\theta+D' \quad (7)$$

The terms C' and D' are included in this approach to account for small scale-factor changes and/or slight offsets that may occur between two runs of an identical calibration sheet. For example, if the calibration sheet is skewed between runs, or the drag applied by the drive roller to the sheet is changed between runs, then the resulting difference between runs would no longer be of the form of Equation (4), and the curve fitting under those circumstances would yield invalid results. Thus, the C' and D' terms are used to account for run-to-run variations and achieve a valid curve-fit, but only the A' and B' terms are ultimately used to derive the calibration values for correcting the characteristic sinusoidal feed errors.

Another, alternative approach to addressing sinusoidal feed errors is to use a pre-printed sheet of calibration media to determine the calibration values. Specifically, this sheet is pre-printed with spaced-apart targets. The locations of the targets, $P_{nom}(s)$, are precisely determined and recorded (stored in the printer's firmware, for example). Any of a variety of techniques can be employed for precisely measuring the target spacing. It is critical, however, that the selected measurement system provides accuracy that is suitably high for linefeed control purposes. It will be appreciated that with such measurement accuracy, the calibration media error term, $P_{err}(s)$ can be considered to be zero. Therefore, the pre-printed calibration sheet need be fed into the printer only once. As the sheet is advanced, its targets are detected by, for example, the sensor 46 that is mounted to the printer carriage. The resulting data set is then curve-fit, as described above, to determine the coefficients A and B. As described above, these coefficients are used in determining the actual target positions corresponding to the apparent target position information provided by the encoder during a printing operation.

Although preferred and alternative embodiments of the present invention have been described, it will be appreciated by one of ordinary skill that the spirit and scope of the invention is not limited to those embodiments, but extends to the various modifications and equivalents as defined in the appended claims.

What is claimed is:

1. A method of determining calibration values for a media advance system of a printer that uses a drive roller for advancing the media and that employs an encoder that is connected to the roller and that provides as output encoder position signals that correlate to the position of the media as the media is advanced in the printer, the method comprising the steps of:

rotating the drive roller out of a first position and to move a sheet of calibration media that has targets thereon so that a set of at least three targets are moved past a sensor for detecting spacing among the set of targets and correlating that spacing to encoder position signals;

rotating the drive roller out of a second position that is different from the first position and to move the sheet of calibration media so that the set of targets are moved past the sensor for detecting spacing among the set of targets and correlating that spacing to encoder position signals;

identifying sinusoidally varying errors between the encoder position signals and the set of targets on the calibration sheet; and calculating calibration values based on the identified errors.

2. The method of claim 1 wherein the calculating step includes canceling calibration media errors.

3. The method of claim 1 wherein the detecting step includes sensing the location of the set of targets with a sensor carried by the printer.

4. The method of claim 1 including the step of generating the calibration sheet with the printer that has the media advance system for which the calibration values are determined.

5. The method of claim 1 wherein the calculating step includes accounting for mechanical variations in the media advance system that occur between the two rotating steps.

6. A media advance calibration method for a printer comprising the steps of:

producing a sheet of calibration media having a set of spaced-apart targets thereon;

providing a sensor that measures the distances between the spaced-apart targets as the media is advanced through the printer;

measuring distances between the set of spaced-apart targets with the sensor;

re-measuring the distances between the set of spaced-apart targets with the sensor; and comparing the measured and re-measured distances to arrive at calibration values for the printer.

* * * * *